US011155437B2

(12) United States Patent
Backlund

(10) Patent No.: US 11,155,437 B2
(45) Date of Patent: Oct. 26, 2021

(54) ESTIMATING THE NUMBER OF PASSENGERS IN AN ELEVATOR SYSTEM

(71) Applicant: KONE Corporation, Helsinki (FI)

(72) Inventor: Johan Backlund, Helsinki (FI)

(73) Assignee: KONE CORPORATION, Helsinki (FI)

( * ) Notice: Subject to any disclaimer, the term of this patent is extended or adjusted under 35 U.S.C. 154(b) by 404 days.

(21) Appl. No.: 16/359,644

(22) Filed: Mar. 20, 2019

(65) Prior Publication Data

US 2019/0218059 A1 Jul. 18, 2019

Related U.S. Application Data

(63) Continuation of application No. PCT/FI2016/050714, filed on Oct. 12, 2016.

(51) Int. Cl.
*B66B 1/34* (2006.01)

(52) U.S. Cl.
CPC ..... *B66B 1/3476* (2013.01)

(58) Field of Classification Search
CPC ..... B66B 3/002; B66B 1/20; B66B 2201/403; B66B 2201/222; B66B 2201/226; B66B 2201/235; B66B 1/34; B66B 1/3476; B66B 2201/225; B66B 1/3484
See application file for complete search history.

(56) References Cited

U.S. PATENT DOCUMENTS 4,612,624 A 9/1986 Tsuji
5,248,860 A * 9/1993 Sirag, Jr. ..... B66B 1/2408 187/380
5,260,526 A * 11/1993 Sirag, Jr. ..... B66B 1/2408 187/382
2010/0195865 A1* 8/2010 Luff ..... H04H 60/33 382/100
2015/0274485 A1* 10/2015 Appana ..... B66B 1/2408 187/381
2016/0292522 A1* 10/2016 Chen ..... G01C 3/08
2016/0295192 A1* 10/2016 Hsu ..... G06K 9/00832
2016/0295196 A1* 10/2016 Finn ..... B66B 3/02
2018/0111793 A1* 4/2018 Miyajima ..... G07C 1/04
2019/0168992 A1* 6/2019 Siikonen ..... B66B 1/28
2019/0202656 A1* 7/2019 Kuusinen ..... B66B 1/2458
(Continued)

FOREIGN PATENT DOCUMENTS

EP 0 547 900 A2 6/1993
WO WO 2004/031062 A1 4/2004

OTHER PUBLICATIONS

International Preliminary Report on Patentability issued in PCT/FI2016/050714 (PCT/IPEA/409), dated Jan. 24, 2019.
(Continued)

*Primary Examiner* — Marlon T Fletcher
(74) *Attorney, Agent, or Firm* — Birch, Stewart, Kolasch & Birch, LLP

(57) ABSTRACT

A solution for estimating the number of persons entering or leaving an elevator car, wherein a stepwise change in passenger load is detected based on a passenger load signal relating to the elevator car, and the change in a passenger count is estimated based on passenger load change ranges depending on traffic intensity and the stepwise change in the passenger load.

15 Claims, 2 Drawing Sheets

(56) References Cited

U.S. PATENT DOCUMENTS

2019/0218059 A1* 7/2019 Backlund ..... B66B 1/3476

OTHER PUBLICATIONS

International Search Report issued in PCT/FI2016/050714 (PCT/ISA/210), dated Mar. 17, 2017.
Written Opinion of the International Preliminary Examining Authority issued in PCT/FI2016/050714 (PCT/IPEA/408), dated Nov. 23, 2018.
Written Opinion of the International Searching Authority issued in PCT/FI2016/050714 (PCT/ISA/237), dated Mar. 17, 2017.

* cited by examiner

ESTIMATING THE NUMBER OF PASSENGERS IN AN ELEVATOR SYSTEM

CROSS REFERENCE TO RELATED APPLICATIONS

This application is a Continuation of PCT International Application No. PCT/FI2016/050714, filed on Oct. 12, 2016, which is hereby expressly incorporated by reference into the present application.

BACKGROUND

An elevator system collects a plurality of statistics relating to passengers and how they use elevators of an elevator system. One of the collected statistics is the number of passengers using the elevator. Although the number of allocated calls in the elevator system gives some information about the actual number of passengers, it does not provide accurate information.

Elevator systems typically use also a load weighting device that provides a signal that indicates weight of an elevator car with passengers. As the weight of the elevator car itself is known, it is possible to estimate the number of passengers entering and exiting the elevator car based on the signal. Although the load weighting device provides additional information about the number of passengers entering and exiting the elevator car, there is still some uncertainty about the exact number of passengers. For example, more than one passenger may enter or exit the elevator car side-by-side. If it also happens that the weight of one passenger is, for example, 60 kg, the resulting 120 kg can be interpreted either as a single passenger weighing 120 kg or two passengers weighing the same 120 kg.

SUMMARY

A solution is provided that provides a more accurate passenger detection solution than the solution using, for example, only a load weighting device to determine the number of passengers. In addition to a signal from the load weighting device, the solution uses information about traffic intensity when estimating the number of passengers.

According to a first aspect of the invention, there is provided a method for estimating the number of persons entering or leaving an elevator car. The method comprises detecting a stepwise change in passenger load based on a passenger load signal relating to the elevator car, and estimating the change in a passenger count based on passenger load change ranges depending on traffic intensity and the stepwise change in the passenger load.

In an embodiment, the method further comprises determining traffic intensity to be applied, and applying a set of passenger load change ranges based on the traffic intensity.

In an embodiment, alternatively or in addition, the method further comprises comparing the stepwise change in the passenger load to the applied set of passenger load change ranges, determining a specific passenger load change range corresponding to the stepwise change in the passenger load, and determining the change in the passenger count based on the passenger count associated with the specific passenger load change range.

In an embodiment, alternatively or in addition, the method further comprises applying a first set of passenger load change ranges for low traffic intensity, and applying a second set of passenger load change ranges for high traffic intensity.

In an embodiment, alternatively or in addition, the method further comprises determining the traffic intensity based on measured and/or forecasted traffic intensity.

According to a second aspect of the invention, there is provided an apparatus for estimating the number of persons entering or leaving an elevator car. The apparatus comprises means for detecting a stepwise change in passenger load based on a passenger load signal relating to the elevator car, and means for estimating the change in a passenger count based on passenger load change ranges depending on traffic intensity and the stepwise change in the passenger load.

In an embodiment, the apparatus further comprises means for determining traffic intensity to be applied, and means for applying a set of passenger load change ranges based on the traffic intensity.

In an embodiment, alternatively or in addition, the apparatus further comprises means for comparing the stepwise change in the passenger load to the applied set of passenger load change ranges, means for determining a specific passenger load change range corresponding to the stepwise change in the passenger load, and means for determining the change in the passenger count based on the passenger count associated with the specific passenger load change range.

In an embodiment, alternatively or in addition, the apparatus further comprises means for applying a first set of passenger load change ranges for low traffic intensity, and means for applying a second set of passenger load change ranges for high traffic intensity.

In an embodiment, alternatively or in addition, the apparatus further comprises means for determining the traffic intensity based on measured and/or forecasted traffic intensity.

According to a third aspect of the invention, there is provided an elevator system comprising at least one elevator car, means for providing a passenger load signal relating to an elevator car and an apparatus according to the second aspect.

According to a fourth aspect of the invention, there is provided a computer program comprising program code, which when executed by at least one processing unit, causes the at least one processing unit to perform the method of the first aspect.

In an embodiment, the computer program is embodied on a computer readable medium.

The means disclosed above may be implemented using at least one processor or at least one processor and at least one memory connected to the at least one processor, the memory storing program instructions to be executed by the at least one processor.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
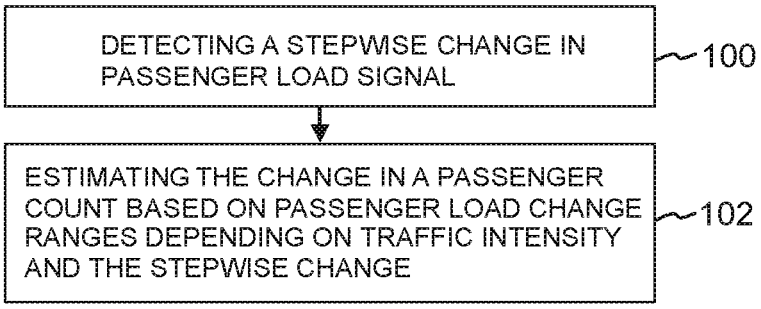
FIG. 1 is a flow diagram illustrating a method of estimating the number of passengers in an elevator system in accordance with one embodiment.

FIG. 1 is a flow diagram illustrating a method of estimating the number of passengers in an elevator system in accordance with one embodiment. The elevator system comprises means for determining a change in a load of an elevator car. The means for determining comprise, for example, a load weighting device.

At 100 a stepwise change in passenger load is detected based on a passenger load signal relating to the elevator car. The stepwise change refers to a sudden change in the passenger load signal indicating that one or more passengers exit or enter the elevator car.

At 102 the change in a passenger count is estimated based on passenger load change ranges depending on traffic intensity and the stepwise change in the passenger load. Different passenger load change ranges may have been defined for different traffic intensities. For example, for estimating the passenger count to be two persons, a low traffic situation may have a load change range of 160-249 kg and a high traffic situation may have a load change range of 150-230 kg. Thus, for example, with a passenger load change of 240 kg, depending on the traffic intensity, the estimated number of passengers may be different. The traffic intensity may be expressed as arriving passengers/time unit. As an example, low traffic intensity may mean ≤20 passengers/10 minutes. High traffic intensity may mean ≥20 passengers/10 minutes.

Figure 2:
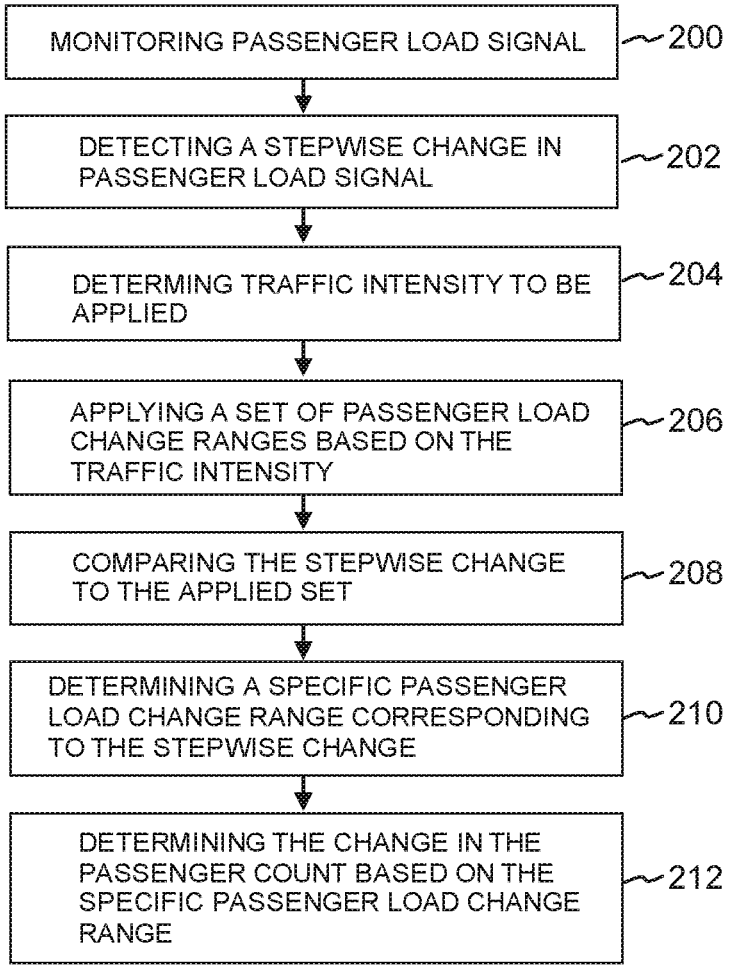
FIG. 2 is a flow diagram illustrating a method of estimating the number of passengers in an elevator system in accordance with another embodiment.

FIG. 2 is a flow diagram illustrating a method of estimating the number of passengers in an elevator system in accordance with another embodiment. The elevator system comprises means for determining a change in a load of an elevator car. The means for determining comprise, for example, a load weighting device.

At 200 a passenger load signal is monitored. A stepwise change in the passenger load is detected at 202 based on the passenger load signal relating to the elevator car. The stepwise change refers to a sudden change in the passenger load signal indicating that one or more passengers exit or enter the elevator car.

At 204 traffic intensity to be applied is determined. The traffic intensity may be a traffic intensity that is currently prevailing in the elevator system. In another embodiment, alternatively or in addition, forecast traffic intensity may be used to determine the traffic intensity. The traffic intensity may be expressed as arriving passengers/time unit. As an example, low traffic intensity may mean ≤20 passengers/10 minutes. High traffic intensity may mean ≥20 passengers/10 minutes.

At 206 a set of passenger load change ranges is applied based on the applied traffic intensity. A specific set of passenger load change ranges may be determined for one or more traffic intensities. Each passenger load change range has an associated passenger count. For example, the low traffic intensity may have a load change range of 160-249 kg for two passengers and the high traffic intensity may have a load change range of 150-230 kg for two passengers. Thus, for example, with a passenger load change of 240 kg, depending on the traffic intensity, the estimated number of passengers may be different.

At 208 the stepwise change in the passenger load is compared to the applied set of passenger load change ranges. At 210 a specific passenger load change range corresponding to the stepwise change in the passenger load is determined. At 212 the change in the passenger count is determined based on the passenger count associated with the specific passenger load change range.

The following Table 1 gives some examples of traffic intensities, passenger load change ranges and associated passenger counts.

TABLE 1

| Traffic intensity | Load change range | Passenger count |
|---|---|---|
| Low | 15-159 kg | 1 |
| High | 15-149 kg | 1 |
| Low | 160-249 kg | 2 |
| High | 150-230 kg | 2 |
| Low | 250-339 kg | 3 |
| High | 231-310 kg | 3 |
| Low | 340-429 kg | 4 |
| High | 311-390 kg | 4 |

Although Table 1 illustrates only two different traffic intensities, in another embodiment, there may be more than two different traffic intensities applied and each of the traffic intensities has its own passenger load change ranges and associated passenger counts.

Figure 3:
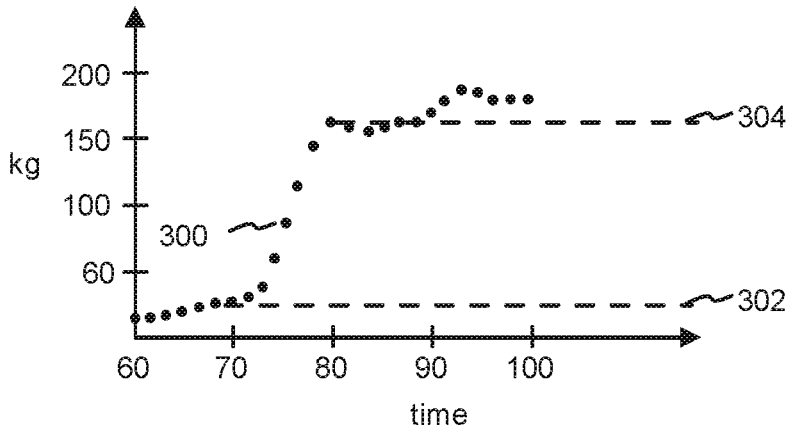
FIG. 3 is a graph illustrating a signal indicating weight as a function of time in accordance with one embodiment.

FIG. 3 is a graph illustrating a passenger load signal 300 indicating load change as a function of time in an elevator system in accordance with one embodiment.

A start load 302 of an elevator car (i.e. a passenger load) at around 70 seconds is approximately 15 kg. This means that the elevator car is empty at first. Between 70-80 seconds, the passenger load rises to an end load 304 of 170 kg. Thus, the detected passenger load is now 155 kg.

Referring back to Table 1, it can be determined that during low traffic intensity, the estimated passenger count is 1, and during high traffic intensity, the estimated passenger count is 2.

Figure 4:
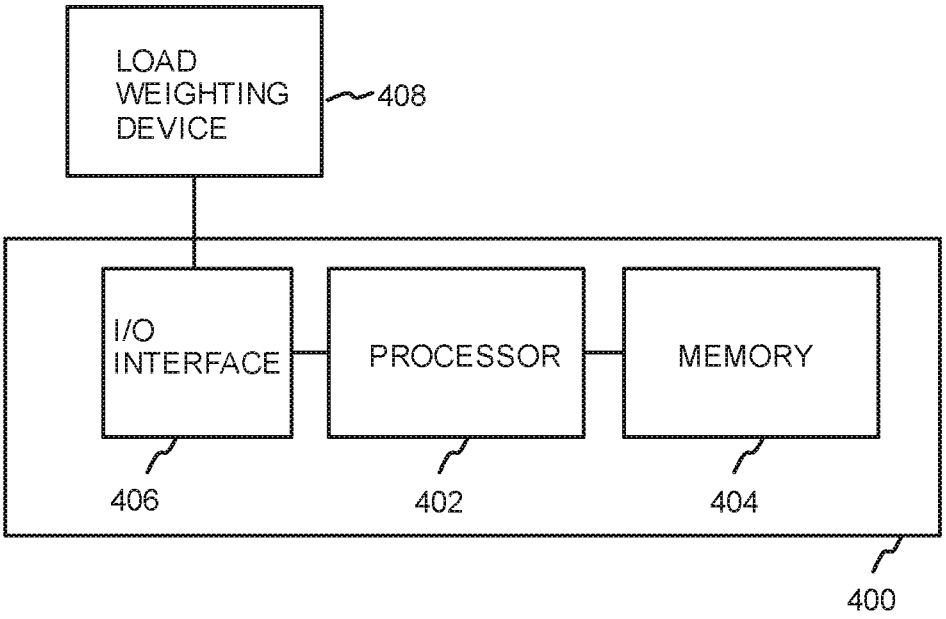
FIG. 4 is a block diagram illustrating an apparatus of operating elevator cars in an elevator system.

FIG. 4 illustrates a block diagram illustrating an apparatus 400 for estimating the number of persons entering or leaving an elevator car. The apparatus 400 comprises at least one processor 402 connected to at least one memory 404. The at least one memory 404 may comprise at least one computer program which, when executed by the processor 402 or processors, causes the apparatus 400 to perform the programmed functionality. The apparatus 400 may also comprise input/output interface 406. The illustrated components are not required or all-inclusive, as any components can deleted and other components can be added. The input/output interface 406 may receive a load signal from a load weighting device 408. The load signal indicates how the load of the elevator car changes when passengers enter or leave the elevator car.

The apparatus 400 may be an elevator system control entity configured to implement only the above disclosed operating features, or it may be part of a larger elevator control entity, for example, a group controller.

The apparatus 400 comprises means for detecting a stepwise change in passenger load based on a passenger load signal relating to the elevator car; and means for estimating the change in a passenger count based on passenger load change ranges depending on traffic intensity and the stepwise change in the passenger load. The apparatus 400 may also comprise at least one of means for determining traffic intensity to be applied, means for applying a set of passenger load change ranges based on the monitored traffic intensity, means for comparing the stepwise change in the passenger load to the applied set of passenger load change ranges, means for determining a specific passenger load change range corresponding to the stepwise change in the passenger load, means for determining the change in the passenger count based on the passenger count associated with the specific passenger load change range, means for applying a first set of passenger load change ranges for low traffic intensity, and means for applying a second set of passenger load change ranges for high traffic intensity, and means for determining the traffic intensity based on measured and/or forecasted traffic intensity. The above means may be implemented, for example, using at least one processor 402 or at least one processor 402 and at least one memory 404 connected to the at least one processor 402, the at least one memory 404 storing program instructions to be executed by the at least one processor 402.

At least some of the illustrated embodiments provide a solution where more accurate passenger detection is obtained. When more accurate passenger detection information is available, this improves also the transport capacity of an elevator system as unnecessary stops can be avoided (for example, when the passenger detection information indicates that there is no room for new passengers in an elevator car). Vice versa, if the passenger detection indicates that there is room for a new passenger or passengers, a new call or calls can be allocated by the elevator system.

The exemplary embodiments of the invention can be included within any suitable device, for example, including, servers, workstations, personal computers, laptop computers, capable of performing the processes of the exemplary embodiments. The exemplary embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for estimating the number of persons entering or leaving an elevator car, the method comprising:

storing passenger load change ranges relating to different traffic intensities, each passenger load change range further being associated with a particular passenger count;

detecting a stepwise change in passenger load based on a passenger load signal relating to the elevator car; determining which of the traffic intensities is to be applied;

determining, among the stored passenger load change ranges, a passenger load change range comprising the changed passenger load and corresponding to the determined traffic intensity; and determining a change in the passenger count based on the passenger count associated with the determined passenger load change range.

2. The method according to claim 1, further comprising:

storing a first set of passenger load change ranges for low traffic intensity; and storing a second set of passenger load change ranges for high traffic intensity.

3. The method according to claim 1, further comprising:

determining the traffic intensity based on measured and/or forecasted traffic intensity.

4. A computer program comprising program code, which when executed by at least one processing unit, causes the at least one processing unit to perform the method of claim 1.

5. A computer program according to claim 4, wherein the computer program is embodied on computer readable medium.

6. A method according to claim 2, further comprising:

determining the traffic intensity based on measured and/or forecasted traffic intensity.

7. A computer program comprising program code, which when executed by at least one processing unit, causes the at least one processing unit to perform the method of claim 2.

8. A computer program comprising program code, which when executed by at least one processing unit, causes the at least one processing unit to perform the method of claim 3.

9. An apparatus for estimating the number of persons entering or leaving an elevator car, the apparatus comprising:

means for storing passenger load change ranges relating to different traffic intensities, each passenger load change range further being associated with a particular passenger count;

means for detecting a stepwise change in passenger load based on a passenger load signal relating to the elevator car;

means for determining which of the traffic intensities is to be applied;

means for determining, among the stored passenger load change ranges, a passenger load change range comprising the changed passenger load and corresponding to the determined traffic intensity; and means for determining the change in the passenger count based on the passenger count associated with the determined passenger load change range.

10. The apparatus according to claim 9, further comprising:

means for storing a first set of passenger load change ranges for low traffic intensity; and means for storing a second set of passenger load change ranges for high traffic intensity.

11. The apparatus according to claim 9, further comprising:

means for determining the traffic intensity based on measured and/or forecasted traffic intensity.

12. An elevator system comprising:

at least one elevator car;

means for providing a passenger load signal relating to an elevator car; and the apparatus according to claim 9.

13. The apparatus according to claim 10, further comprising:

means for determining the traffic intensity based on measured and/or forecasted traffic intensity.

14. An elevator system comprising:

at least one elevator car;

means for providing a passenger load signal relating to an elevator car; and an apparatus according to claim 10.

15. An elevator system comprising:

at least one elevator car;

means for providing a passenger load signal relating to an elevator car; and an apparatus according to claim 11.

* * * * *